United States Patent [19]

Masel

[11] 4,256,203

[45] Mar. 17, 1981

[54] SELF-ADJUSTING ELEVATOR LEVELING APPARATUS AND METHOD

[75] Inventor: Marvin Masel, Teaneck, N.J.

[73] Assignee: Otis Elevator Company, Hartford, Conn.

[21] Appl. No.: 970,784

[22] Filed: Dec. 18, 1978

[51] Int. Cl.[3] ..... B66B 1/40

[52] U.S. Cl. ..... 187/29 R

[58] Field of Search ..... 187/29

[56] References Cited

U.S. PATENT DOCUMENTS

| | | | |
|---|---|---|---|
| 3,458,014 | 7/1969 | Yeakley | 187/29 |
| 3,773,146 | 11/1973 | Dixon, Jr. et al. | 187/29 |
| 4,134,476 | 1/1979 | Zolnerovich, Jr. et al. | 187/29 |
| 4,141,435 | 2/1979 | Satoh | 187/29 |

*Primary Examiner*—J. V. Truhe

*Assistant Examiner*—W. E. Duncanson, Jr.

*Attorney, Agent, or Firm*—Robert E. Greenstien

[57] ABSTRACT

A first memory contains the location of each floor in the elevator shaft. A second memory stores a distance correction for each floor. The sum of the stored correction and the stored location is compared with the actual car location in the shaft to position the car at a floor. Each time the car door opens, after a delay, the leveling distance is sensed and if the car is below a preselected level zone one unit of correction equal to a preselected distance is added to the stored correction. The resulting new correction is stored in the second memory. On a successive stop at the same floor the car will position that preselected distance closer to the level zone until it is above the zone, when a unit of correction is subtracted from the stored correction. In this fashion the car clusters around the level zone.

4 Claims, 3 Drawing Figures

SELF-ADJUSTING ELEVATOR LEVELING APPARATUS AND METHOD

This invention relates generally to apparatus for positioning an elevator car at a floor or landing, and in particular, a self-adjusting elevator car leveling apparatus and methods.

Due to a gradual floor location drift in most buildings, it is extremely difficult to ensure proper leveling of the elevator car at each floor. There are numerous reasons for this drift, and among these are building settlement, building expansion and contraction, and cable expansion and contraction. Moreover, in the typical elevator installation there is a car position encoder which is driven through a mechanical linkage (usually a steel tape) which distorts with age and expands and contracts with temperature at a different coefficient than the building. Consequently, the precise location of floors in the building is dynamic.

For the most part in prior art systems the only way to avoid these problems is to periodically recalibrate the car position encoder. Generally speaking, recalibration involves the adjustment of switches which are actuated as the car approaches the floor. This recalibration process is clearly expensive and time consuming; moreover, it must be done regularly.

SUMMARY OF THE INVENTION

Among the objects of the present invention is to provide an elevator control system which includes a self-adjusting car leveling apparatus which does not require routine maintenance in order to compensate for variations in the floor distances.

In accordance with the present invention the approximate location of each floor with respect to car movement is stored in a first memory. Each time the car door opens at a floor the position of the car with respect to a preselected level zone is sensed and if it is sensed that the car is below the zone, one standard unit of correction is added to a second memory. To position the cab at the floor at successive landings, this stored correction is added to the stored floor location so that the next time the car stops at the floor, it is positioned closer to the leveling zone. On such successive landings an additional unit of correction is added from the previously stored units for that particular floor until the car stops above the zone, at which time a unit is subtracted from the memory so that the car is positioned below the zone on the next landing. Thus through successive door openings a desired correction for each floor is accumulated or stored in successive unit steps, causing the car to stop incrementally higher until it is above the level zone, then incrementally lower, until it is below the zone. The car position clusters around the level zone, as a result.

A feature of the invention is that there is no leveling (movement) of the elevator car while it is stopped at the landing. The importance of this is that it avoids any possibility that the car will move while the passengers are entering and leaving. In some earlier approaches, not self-adjusting, however, the brake might be released as the door is opened to bring the elevator within the desired leveling range; this is clearly unacceptable.

A related feature of the invention is that the self-adjusting apparatus is particularly adaptable to high speed elevator installations. In high speed elevator installations it is important to know the distance the car moves between floors accurately. That information is utilized to control car speed braking and door opening as the car approaches a floor in order to increase transit time accurate information as to the proper leveling distance allows for a more precise computation of that information. Therefore a separate floor correction memory, as provided by the present invention, is easily utilized together with a main system memory containing the stored floor positions for providing precise floor location data for optimum car positioning and door opening speed.

These and other objects of the invention will be obvious to those skilled in the art from the following detailed description and claims wherein:

DETAILED DESCRIPTION

In the following description such devices as memories, gates, comparators, transducers and delays are shown and their operation described in context with the present invention. The individual operation and configuration of such devices is widely known and except where it is necessary to an understanding and appreciation of the present invention, such details are not necessary and therefore are not given.

Figure 1:
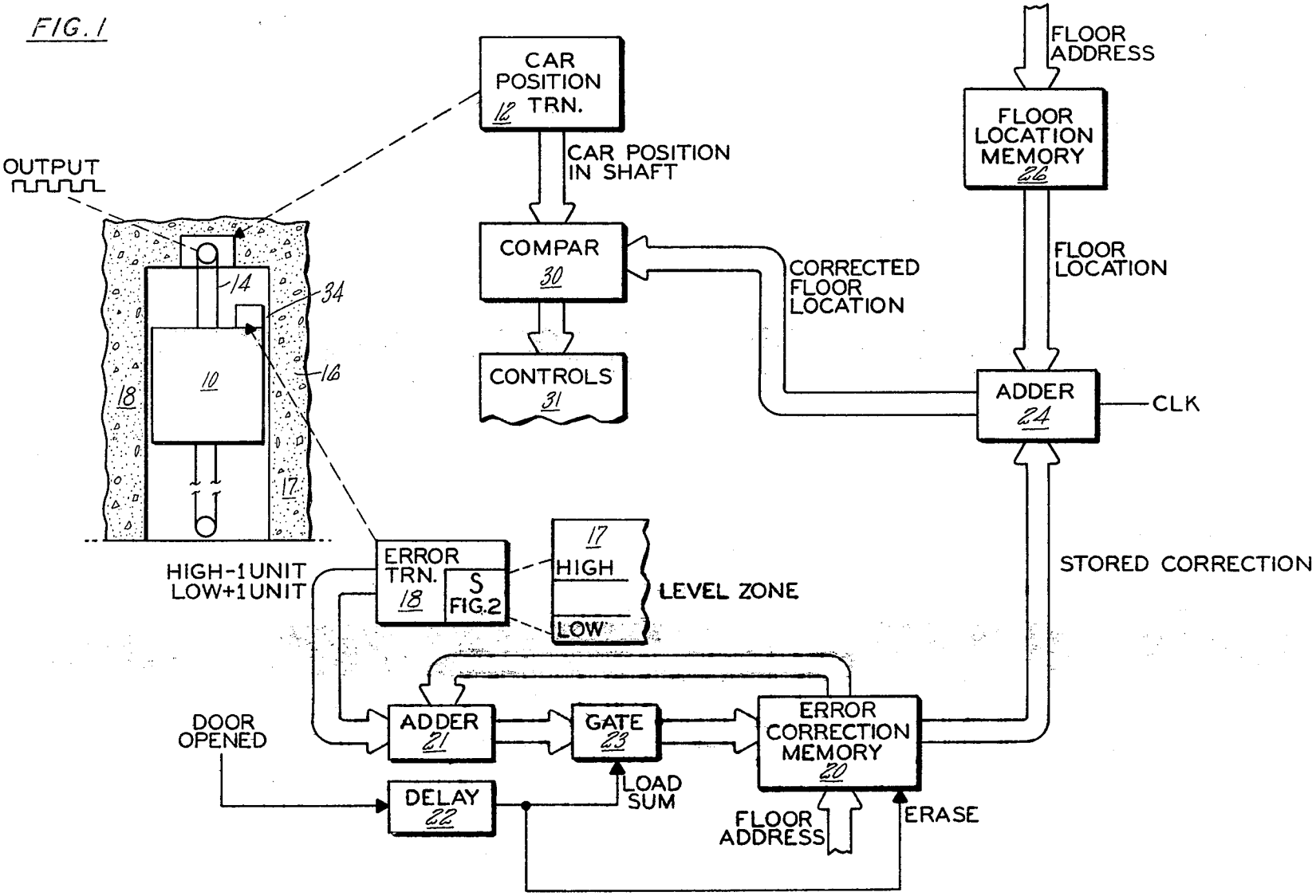
FIG. 1 is a functional block diagram of an apparatus according to the present invention referenced to an associated elevator car in a shaft or hoistway.

Referring to FIG. 1, the position and direction of movement of an elevator cab or car 10 is obtained through a position transducer device 12 connected to the cab through a tape 14. This transducer is of the type previously discussed and is well known in the art. When the car 10 is positioned at a floor 16, an error detection transducer 18 located on the car determines if it is high or low with respect to a level zone by reference to a portion of the shaft wall 18.

The error transducer produces a single unit output signal. A polarity is assigned to this unit to indicate if the car is high or low; e.g. high being $-1$ and low being $+1$. The unit represents a predetermined distance in the shaftway. As described hereinafter in more detail, the car is positioned higher or lower by one unit each time it is positioned at a particular floor until it "overshoots" beyond floor level, when an opposite correction is then made. The car thus clusters around the floor level and its average position is within the level zone.

An error correction memory unit 20 stores an accumulated count of the net error correction units for each floor. This accumulated count is summed in an adder 21 with the output from the error transducer each time the car comes to a particular floor. The output from the adder hence is a modified distance correction consisting of the stored correction plus or minus one unit. When the door opens a signal is sent to a delay unit 22, and after a delay (while the car settles) a gate 23 is activated to load the output of the adder into the memory, which is thus updated with the modified distance correction. In this fashion, each time the car is positioned at a floor the contents of the error correction memory is updated by adding or subtracting one correction unit from the previous contents therein to bring the car closer to the floor.

Through another adder 24 the output from the error correction memory is summed with the approximate floor location stored in a floor position memory 26. The adder output is an adjusted floor location ± the stored correction. These stored locations correspond roughly to the corresponding output from the position transducer for each floor. The adjusted floor location is compared with the output from the position transducer in a comparator 30, and if a match occurs (adjusted floor location=transducer output), a signal is sent to appropriate control apparatus 31 to regulate the car movement. The apparatus 31 has no bearing to the present invention, and therefore is not described herein in detail.

In the initial installation of the elevator system, the error correction memory 20 is empty and thus on the first cab positioning at each floor a match will occur in the comparator when the output from the position transducer equals the output from the floor position memory. However, if the car is above or below the level zone, a correction will be loaded into the correction memory in the manner previously set forth and on the successive positioning at the same floor, that additional one unit of correction will be added or subtracted, as the case may be, with the floor position memory output; consequently a match will occur at a different transducer output level corresponding to a position of the cab higher or lower corresponding to the distance of that one preselected correction unit. Thus it can be appreciated that the leveling process and updating of the correction memory occurs on successive door openings, but not while the doors are in fact open.

The correction memory 20 can have six bits assigned to each floor for accumulated correction units. A typically acceptable leveling range for an elevator cab is approximately ½ inch and thus one unit output from the transducer can correspond to one bit in the correction memory or approximately 1/64th of an inch. As a result on successive cab positionings the cab will position 1/64th of an inch higher or lower. The distance correlation is, however, completely arbitrary; the sole governing factors are the desired leveling range and the size of the correction memory vis-a-vis cost.

Figure 2:
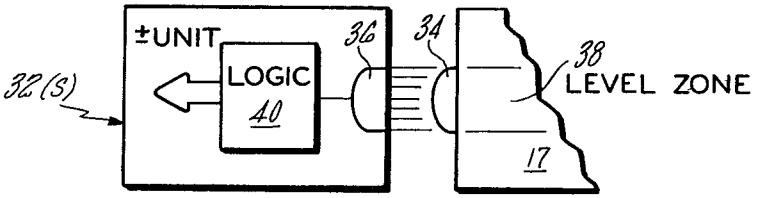
FIG. 2 is a functional block diagram of a simple optical level zone sensor that can be used in the apparatus.

FIG. 2 shows a single sensor system 32 that can be used in the error transducer. An illuminating device 34 is positioned on the shaft wall 18. If a detector 36, located on the car is illuminated, it indicates that the car is above the level zone 38. Through a basic logic unit 40, a single unit of correction is generated together with an appropriate command indicating that the unit of correction data is generated, indicating a "high" position, in which case a unit of correction is subtracted from the stored correction. But if the detector 36 is illuminated, one unit of correction should be added. In this way, the car clusters around the level zone. It is never more than the standard unit (preferred to be about 1/64th of an inch) above or below and its average position is within the level zone. In essence this is a prescribed, controlled oscillation around the level zone.

Figure 3:
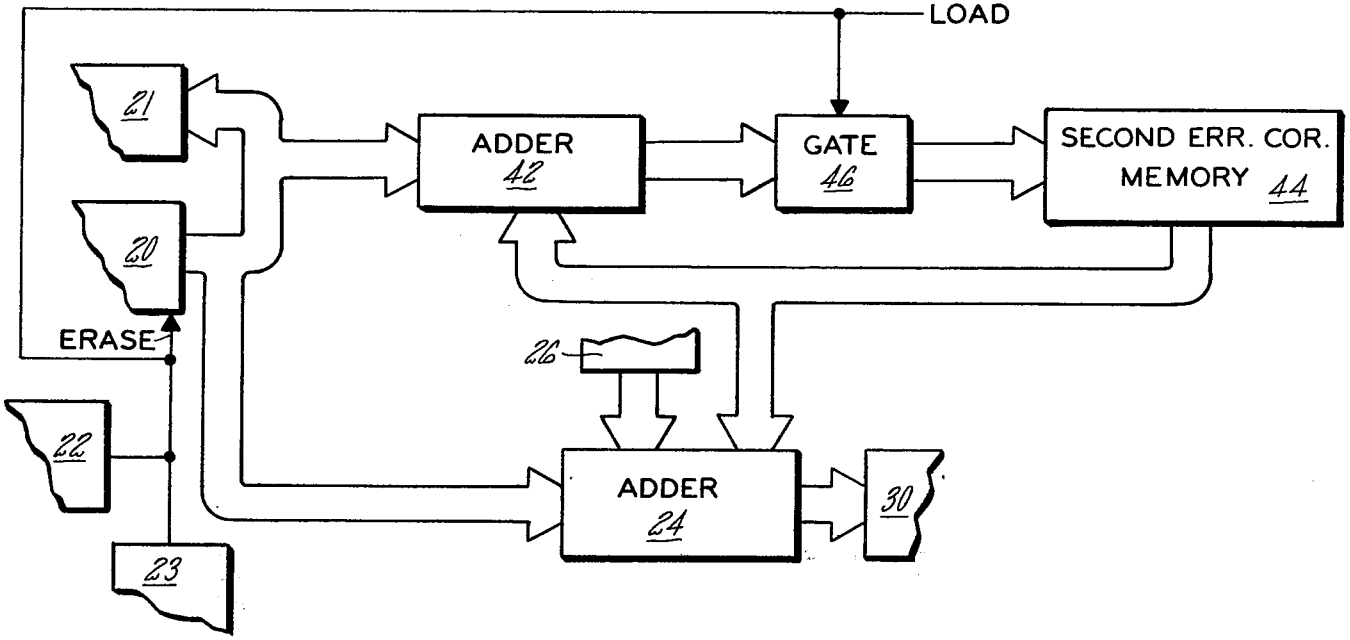
FIG. 3 is a functional block diagram of another embodiment of the present invention.

FIG. 3 shows a modification which can be made to the apparatus of FIG. 1. The stored correction in the correction memory 20 is supplied to an adder 42 where it is added to the corresponding contents of a second error correction memory 44. The output from the adder 42 is transferred to the second memory 44 upon an erase command to a gate 46. The sum is thereby loaded into the memory 44 in place of its previous contents. The erase command erases the stored correction in the error correction memory 20. Thus in effect the contents of the correction memory are transferred to the second correction memory 44. The contents of the second correction memory are supplied to the adder 24 where they are summed with the floor position memory contents and any subsequently added error corrections in the correction memory 20. The resulting transducer output at which a match will occur is the sum of the contents of the correction memory 20, the contents of the floor position memory 26 and the contents of the second correction memory 44. The basic arithmetic logic for the floor position hence is the same as the apparatus of FIG. 1, but the use of the second memory distributes the contents of the correction memory 20. Consequently the size of the correction memory 20 can be smaller. Moreover, in a new elevator installation, changes in the structure and components will be reflected at any time in the stored error correction in the correction memory 20. In a new installation a substantial portion of the accumulated error will not vary with time as it will result from settlement in the structure and the elevator system components. Thus there is no need to constantly update this type of information and carry it in the volatile correction memory 20. Nonetheless this information must be added to the stored floor position each time in order to position the car close to the level zone, which is accomplished in the arrangement according to FIG. 3. Of equal importance in this context is that in the event of a power failure, all the stored correction information will not be lost. For that end, it is possibly desirable to make the second correction memory 44 not volatile and thus have it loaded at a predetermined time after the elevator system is installed.

It is of course possible to effect the present invention through the use of presently known computer systems and techniques. Since the computer can provide the basic means for carrying out steps which are inherent in the foregoing described embodiments and related method the use of a computer is strongly suggested, particularly a microprocessor based system. Nevertheless it is equally apparent that the invention can be accomplished through the use of hard wired circuitry possibly as shown in the drawing.

Moreover there are other possible forms of floor position sensors beyond that shown in FIG. 2. Among the alternatives are mechanical switches, proximity switches and other various types of optical encoder positioned on the shaft wall and the car to provide an output whenever the car is outside of a predetermined level zone.

A more sophisticated application of the invention, particularly the method, may involve averaging the successive error corrections obtained from the transducer over a preselected number of door openings. This average correction would avoid possible random correction errors. The average correction may be loaded into the correction memory in a similar, if not identical, fashion to that shown and described previously.

The foregoing detailed description will suggest numerous modifications and variations which can be made in and to the preferred embodiment of the invention without departing from its true scope and spirit. The following claims are therefore intended to embrace all such modifications and variations.

I claim:

1. A self-adjusting elevator car leveling apparatus, comprising, a position transducer for indicating the location of the car in the shaft, a first memory for storing approximate floor locations, a second memory for storing a distance correction for each floor to level the car at the floor, means for generating, for each floor, an adjusted floor location from said stored floor locations and stored distance correction for each floor, means for comparing said adjusted floor location and said indicated car location to control car movement, means for modifying a previously stored correction distance for each floor by a predetermined distance increment on each stop at the floor until the car is above a predetermined level zone, and thereupon for modifying a previously stored correction for the floor by said predetermined distance increment on each stop until the car is below said zone, whereby the average car position is within said level zone.

2. The apparatus of claim 1, wherein, said modifying means includes a transducer for generating a signal if the car is above or below said zone, said signal corresponding to a preselected distance increment and coded to indicate whether the stored correction should be increased or decreased by said distance.

3. The apparatus of claim 2, wherein, said modifying means includes, means for adding or subtracting said distance increment from said stored distance correction to produce a second distance correction which is subsequently stored in place of a previous distance correction in said second memory at a selected time after the car door opens.

4. A method for leveling an elevator car at a floor, comprising the steps, storing the floor location, storing a distance correction to level the car, generating an adjusted floor location from said stored floor location and said stored distance correction, moving the car to the adjusted floor location, sensing if the car is above or below the floor level, incrementally modifying a previously stored correction by a predetermined distance when the car is moved to the adjusted floor location, until the car is above the zone, and then incrementally modifying a previously stored correction when the car is moved to the adjusted floor location until the car is below the zone.

* * * * *

UNITED STATES PATENT AND TRADEMARK OFFICE

CERTIFICATE OF CORRECTION

PATENT NO. : 4,256,203

DATED : March 17, 1981

INVENTOR(S) : Marvin Masel

It is certified that error appears in the above—identified patent and that said Letters Patent is hereby corrected as shown below:

Column 2, Line 2: "increase" should be --decrease--, and after "time", insert --.--

Column 2, Line 3: Before "accurate", insert --Consequently, having--

Signed and Sealed this

*Twenty-fifth* Day of *May 1982*

[SEAL]

*Attest:*

*Attesting Officer*

GERALD J. MOSSINGHOFF

*Commissioner of Patents and Trademarks*